US007401384B2

(12) United States Patent
Chen

(10) Patent No.: US 7,401,384 B2
(45) Date of Patent: Jul. 22, 2008

(54) PLIABLE HANDLE

(75) Inventor: Chien-Hung Chen, Xiamen (CN)

(73) Assignee: Xiamen Jundian House Omaments Co., Ltd., Xiamen (CN)

( * ) Notice: Subject to any disclaimer, the term of this patent is extended or adjusted under 35 U.S.C. 154(b) by 269 days.

(21) Appl. No.: 11/241,433

(22) Filed: Sep. 30, 2005

(65) Prior Publication Data

US 2007/0074374 A1 Apr. 5, 2007

(51) Int. Cl.
*A45C 7/00* (2006.01)

(52) U.S. Cl. ..... 16/431; 16/436; 16/421; 16/DIG. 12; 16/DIG. 19; 135/25.4

(58) Field of Classification Search ..... 16/430–431, 16/435, 436, DIG. 12, DIG. 18, DIG. 19; 15/143.1, 144.1, 145, 443; 81/177.1, 177.6, 81/489; 135/17, 24, 25.4; 277/412; 30/322, 30/323, 340

See application file for complete search history.

(56) References Cited

U.S. PATENT DOCUMENTS 3,357,708 A * 12/1967 Parr ..... 277/419
4,035,089 A * 7/1977 Schwartz et al. ..... 401/6
5,713,104 A * 2/1998 Giampaolo, Jr. ..... 16/422
5,857,241 A * 1/1999 Camp et al. ..... 16/436
6,959,469 B2 11/2005 Blauer et al.
6,968,599 B2 11/2005 Blauer et al.
2004/0205938 A1 10/2004 Blauer et al.
2005/0155186 A1* 7/2005 McGuyer et al. ..... 16/430
2006/0021196 A1 2/2006 Blauer et al.
2006/0124158 A1* 6/2006 Lin et al. ..... 135/24
2006/0174450 A1* 8/2006 Chen ..... 16/436

* cited by examiner

*Primary Examiner*—Chuck Y. Mah
(74) *Attorney, Agent, or Firm*—Greer, Burns & Crain, Ltd.

(57) ABSTRACT

A pliable handle includes a core member, an outer sheath, and gel disposed between the core member and the outer sheath. There is an outer annular flange around its top. The outer sheath has an opening on its top and a closed bottom, an inner annular flange on its top; and the outer sheath is disposed about the core member. Below the inner annular flange of the outer sheath and the outer annular flange of the core member define the gap portion, which is filled with gel. There is an annular flange which corresponds with the annular groove on the core member below the inner annular flange of the outer sheath. The present pliable handle can be secured to walking sticks, golf clubs, ski poles, tennis rackets, battledores, and umbrellas.

6 Claims, 7 Drawing Sheets

PLIABLE HANDLE

FIELD OF THE INVENTION

The present invention generally relates to handles of hand-held devices, sports equipments or rackets.

BACKGROUND TECHNOLOGY

Handles of hand-held devices, such as handles of walking sticks and umbrellas, generally include a core member having a insert bore on its top outer sheath disposed about the core member and the gel disposed between the core member and the outer sheath. The applied force causes the pliable handle to deform immediately; after the applied force is released, the deformation of the handle will remain for a period of time before the handle returns to its original shape until the movement of gel is finished. The pliable handle keeps deformation for a period of time after applied force is released, it is so-called memory effect that takes the fancy of consumers. When assembling the pliable handle, the gel must be injected through the injection bore into the gap between the core member and the outer sheath. Because the movement of the gel is too slow like oil, even a small gap would lead to the leak of the gel. When the pliable handle is gripped, the applied force causes the load movement of the gel. The gap between the core member and the outer sheath will easily become the portion through which the gel leaks. For preventing the leak of the gel, we must use more components to seal the both ends of the outer sheath. For example, in us patent-US 2004/0205938 A1 disclosed on 21, Oct., 2004 "PLIABLE HANDLE", FIG. 20 shows a pliable handle which is composed of six components after injecting the gel. as the appended FIG. 1 shows. But in this case, the cost is too expensive and it takes much time for assembling. For keeping components close to each other, we must machine the components exactly, so the cost is too much. The FIG. 18 of the patent illustrates the most simple pliable handle, with reference to appended FIG. 2, there is a bore for central rod on the top of the core member 1710, the outwards extending flange 1711 is on the top of the core member 1710, the gel injection bores 1712*a* 1712*b* is formed on the outwards extending flange 1711; the bottom portion 1713 of the core member 1710 forms a protuberance like mushroom. The outer sheath 1720 is like a straight tube that includes an open top portion 1721 and a closed bottom portion 1722. There is an inwards extending flange on the top portion 1721. The bottom portion 1713 of the core member 1710 is inserted through the opening 1723 of the outer sheath 1720 to the outer sheath 1720, disposing the outer sheath 1720 to the outwards extending flange 1711 and the bottom portion 1713 of the core member 1710. The bottom portion 1713 of the core member 1710 touches the bottom portion 1722 of the outer sheath 1720, the inwards extending flange of the top portion 1721 threadingly mate with the outwards extending flange 1711 of the core member 1710. There is a gap between the inner of the outer sheath 1720 and the central portion 1714 of the core member. At this point, using the 2 nozzles of the injector to stab the inwards extending flange of the top portion 1721 through the gel injection bores 1712*a* 1712*b* formed on the outwards extending flange 1711 and injecting the gel into said gap. Remove the 2 nozzles of the injector, screwing the outer screw 1733 of the central rod 1730 into the bore for central rod on the top of the core member 1710, making the outer shoulder 1732 of the outer screw 1733 press on the inwards extending flange of the top portion 1721 tightly, the inwards extending flange on the top portion 1721 is sealed between the distal end of the outer shoulder 1732 of the central rod 1730 and the proximal end of the outwards extending flange 1711. The structure of the pliable handle is simple, but there are some disadvantages on it as follow:

1, although using the thread outer shoulder to press on the outer sheath which is on the top of the core member, the outer shoulder will loose after using the handle for a long time, and it can not prevent gel-leaking.

2, the handle must be assembled primarily during the handle assembly process, and the gel is injected, then assembling the other components of the pliable handle at last. For example, the core member and the outer sheath are assembled primarily, and injecting the gel; fixing the central rod in the core member, its outer shoulder seals the outer sheath. Because of using the 2 nozzles of the injector to stab the inwards extending flange of the top portion through the gel injection bores formed on the outwards extending flange and injecting the gel into the gap, the operator must find the gel injection bores formed on the outwards extending flange carefully after assembling the outer sheath, and insert the 2 nozzles of the injector into the 2 gel injection bores, it takes much time, the process of injection is long; so the components can not be assembled immediately. The result is that the period of production is too long and the cost is too much.

BRIEF SUMMARY OF THE INVENTION

The present invention provided a pliable handle that has a simple structure, and is securely sealed, and is assembled fast.

The present invention provided a method which the bore on the core member and the gel injection are needless.

The present invention bases on the means: a pliable handle, including the core member the outer sheath the gel disposed between the core member and the outer sheath. Because the outer sheath is formed of vulcanized silicon or other flexible materials, it has good flexibility, the gel has good viscidity, the structure of the present invention:

The core member, there is a outwards extending flange around its top;

The outer sheath, it has an opening on its top and a closed bottom, there is a inwards extending flange on its top; the outer sheath is disposed about the core member. Below the inwards extending flange of the outer sheath and the outwards extending flange of the core member define the gap portion, which is filled with the gel.

Said outwards extending flange of the core member does not communicate with the gap that is filled with the gel, the gap that is filled with the gel is close. There is a groove on the center of the outwards extending flange; there is an annular flange which corresponds with the annular groove on the core member below the inwards extending flange of the outer sheath.

Below the outwards extending flange of the core member, the structure is cylindrical shape, it does not communicate with the gap that is filled with the gel.

A bore is on the top of the core member along the longitudinal axis of the core member, it does not communicate with the gap that is filled with the gel.

Said outwards extending flange is on the top of the core member, there is a protuberance above the center of the outwards extending flange, setting a securing component that presses on the inwards extending flange of the outer sheath, and sealing it.

Said securing component is an annular end cap; the protuberance has the thread portion, the annular end cap has a thread portion in it.

Said core member is transparent, a bore is on the top of the core member along the longitudinal axis of the core member, there is a luminous component in it.

A pliable handle including:

A core member with a trumpet-shaped flange on its top;

An outer sheath which has an opening on top and a closed bottom, there is a inwards extending flange on its top;

The outer sheath is disposed about the core member, below the inwards extending flange of the outer sheath and the outwards extending flange of the core member defining the gap portion, which is filled with the gel.;

Said outwards extending flange of the core member does not communicate with the gap that is filled with the gel. The gap that is filled with the gal is close; there is a annular groove on the trumpet-shaped flange; there is a annular flange which corresponds with the annular groove on the core member below the inwards extending flange of the outer sheath.

The method that forms a pliable handle includes steps as follow:

Providing a core member, there is an annular flange on its top;

The outer sheath, it has an opening on its top and a closed bottom, there is an inwards extending flange on its top;

The outer sheath is disposed about the core member. Below the inwards extending flange of the outer sheath and the outwards extending flange of the core member define the gap portion, which is filled with the gel.

The quantity of the gel is provided according to the space of the gap.

The gel covers the outer of the core member below the annular flange of the core member;

Expand the opening of the outer sheath, and cover the core member that is covered with the gel with the outer sheath.

The pliable handle of the present invention, the joint of the core member and the outer sheath is sealed in the integrative seal structure.

The annular groove on the center of the outwards extending flange corresponds with the annular flange below the inwards extending flange of the outer sheath, the annular flange below the inwards extending flange of the outer sheath that is flexible formed a seal, so as to weaken the influence caused by movement of the gel when the handle is held by hand, the said influence is produced between the outwards extending flange of the core member and inwards extending flange of the outer sheath, and minimize the risk of the gel-leaking. Use the protuberance above the center of the outwards extending flange to connect to the securing components, the securing components press on the inwards extending flange of the outer sheath around the protuberance.; Separate the securing components from the central rod. Although the loose occur between the pliable handle and central rod for long usage, it can not effect the seal-function of the securing component. There is a thread portion on the protuberance, the securing component is a annular cap having inner thread portion.

The present invention bases on the flexibility of the outer sheath and the viscidity of the gel, the outer of the core member is covered with the gel at first, and the outer sheath is expanded at the same time, then cover the core member that is covered with the gel with the outer sheath. The gel injection bore that is used in the gel injection method is canceled in the said method. The bottom of the core member is unnecessary to form a protuberance forth, for machining easily, the seal of the pliable handle is good after assembly.

So compared to the existing technology, the structure of component of the present invention is simple, the mold is even simpler, the processing is convenient, the assembly is quickly, the cost is low. It is unnecessary to pierce the inwards extending flange of the outer sheath especially, the integrality of the outer sheath is good, the useful life is long.

The present pliable handle can be secured to the walking stick, golf club, ski stick, tennis racket, battledore, and umbrella, and may have the illuminating function.

DETAILED DESCRIPTION OF THE PREFERRED EMBODIMENTS

Figure 1:
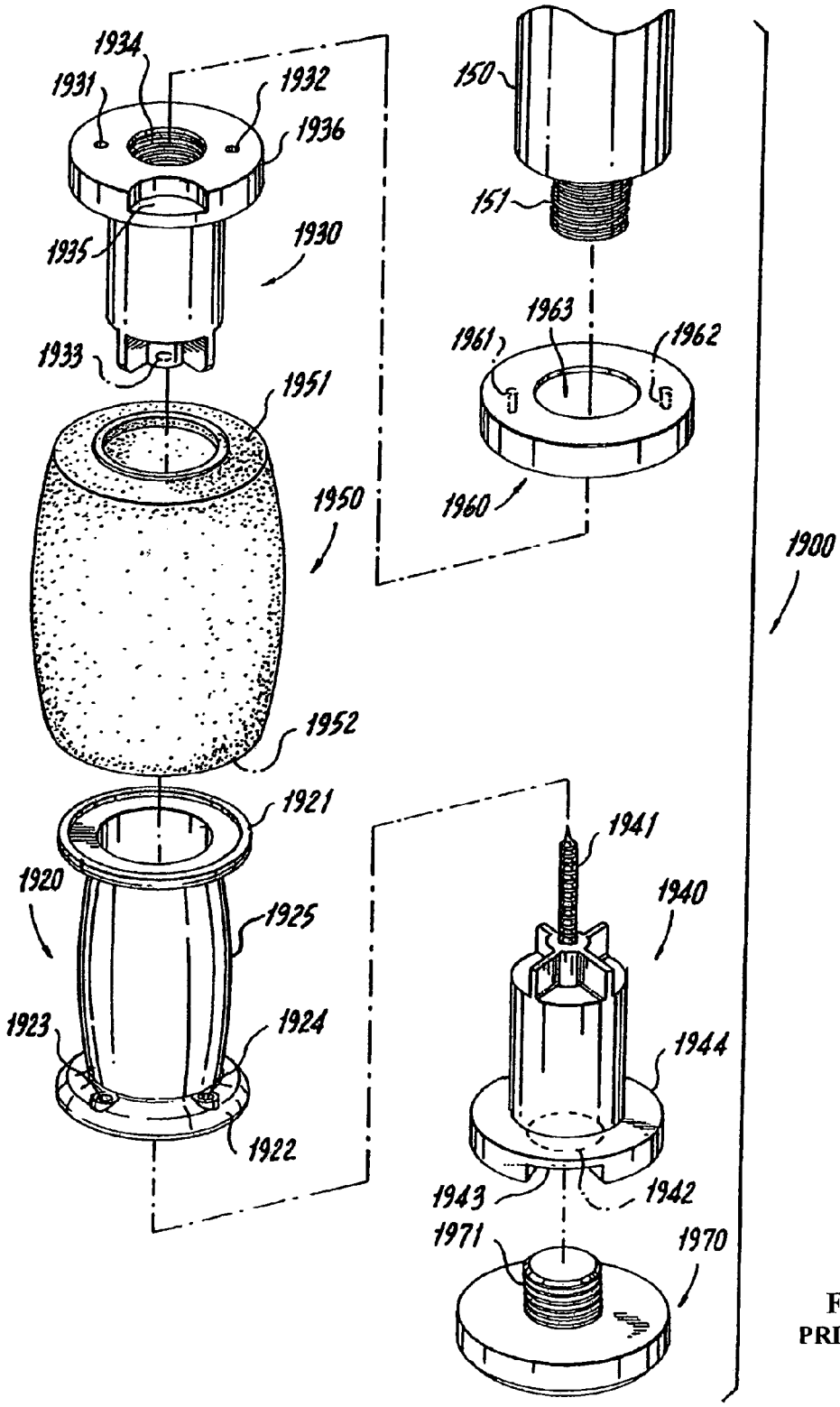
FIG. 1 PRIOR ART
FIG. 1 is an exploded perspective view of the exemplary embodiment of the pliable handle based on the exiting technology.
Figure 2:
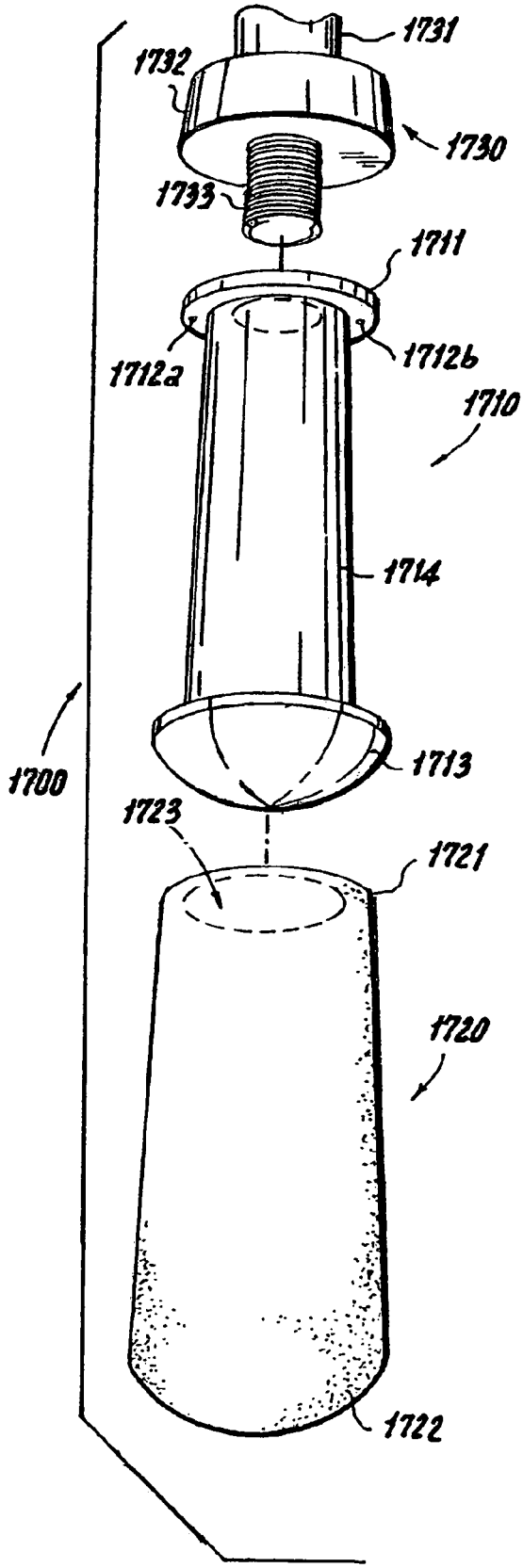
FIG. 2 PRIOR ART
FIG. 2 is another exploded perspective view of the exemplary embodiment of the pliable handle based on the exiting technology.
Figure 3:
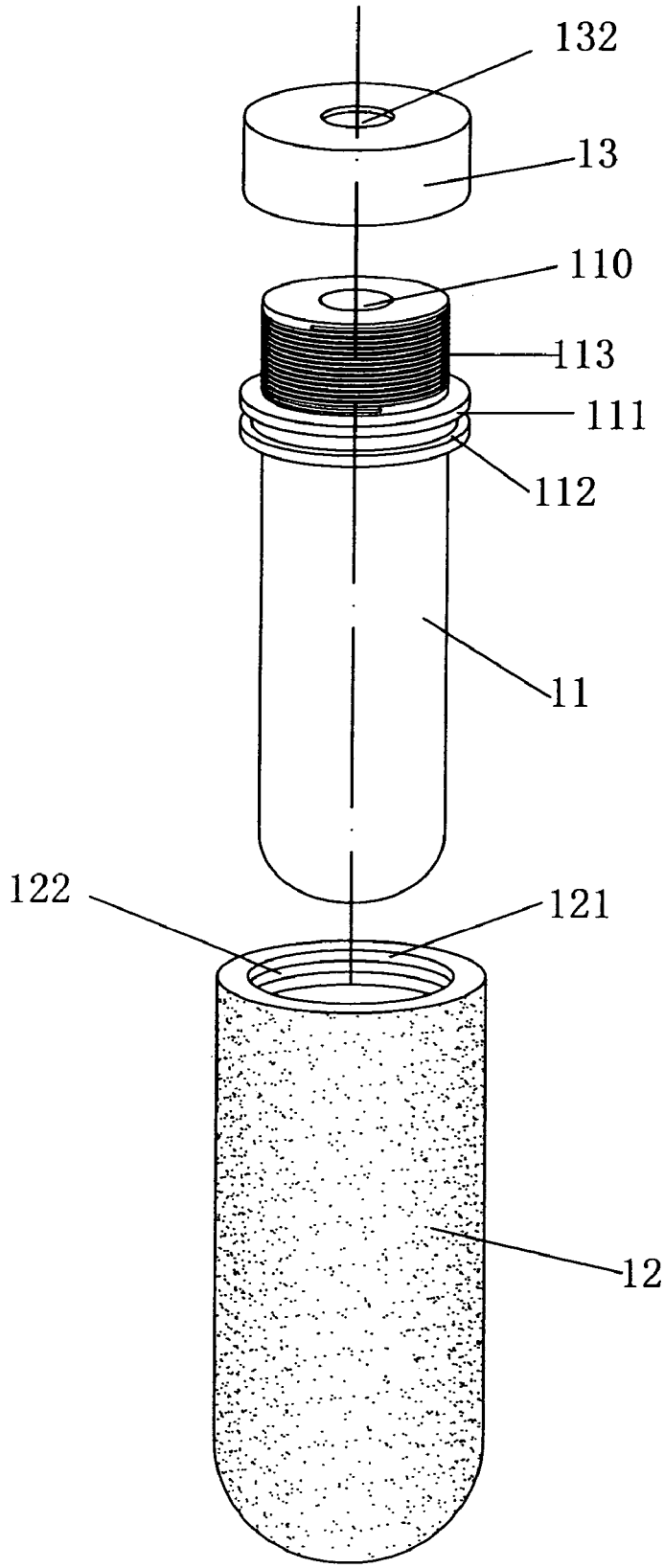
FIG. 3 is an exploded perspective view of the first exemplary embodiment of the pliable handle of the present invention

The first embodiment, the embodiment of the pliable handle of the present invention can be secured to a device, such as the pole of the walking stick, gold club, ski stick, tennis racket, battledore, and all kinds of umbrellas. As FIG. 3 shows, the pliable handle include a core member 11, a outer sheath, a proximal cap 13, and the gel 14.

The core member 11 is stick-shaped, there is a bore 110 for central rod on the top of the core member. There is the outwards extending flange 111 on the top of the core member 11; the outwards extending flange 111 is divided into two portions -upper portion and lower portion by the annular groove 112 on the center of the outwards extending flange 1. There is a protuberance 113 above the center of the outwards extending flange 111; the protuberance 113 has the thread portion.

The outer sheath 12 has an opening on top and a closed bottom, there is a inwards extending flange 121 in its opening; there is a annular flange 122 which corresponds with the annular groove 112 on the core member 1 below the inwards extending flange 121.

Figure 4:
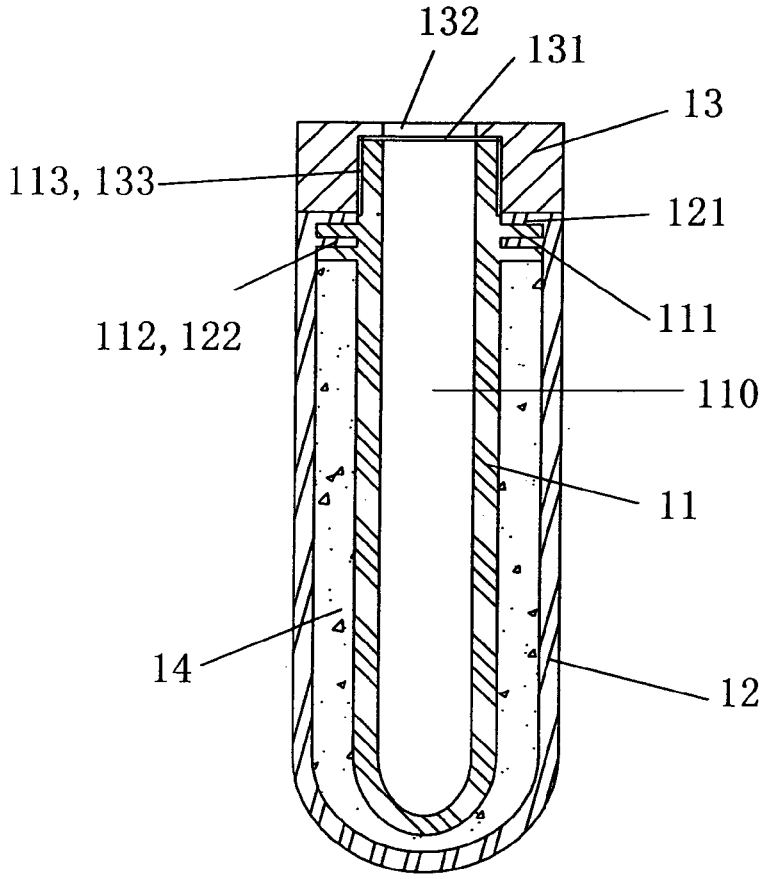
FIG. 4 is a cross-sectional view of the first exemplary embodiment of the pliable handle of FIG. 3.

Compared to FIG. 4, setting a trapezium-shaped bore on the center of the annular cap 13, therein the big bore 131 has a thread portion which corresponds with the thread portion of the protuberance 113 on the top of the core member 11, the diameter of the small bore 132 is slightly bigger than the diameter of bore 110 for central rod of the core member 11.

Figure 5:
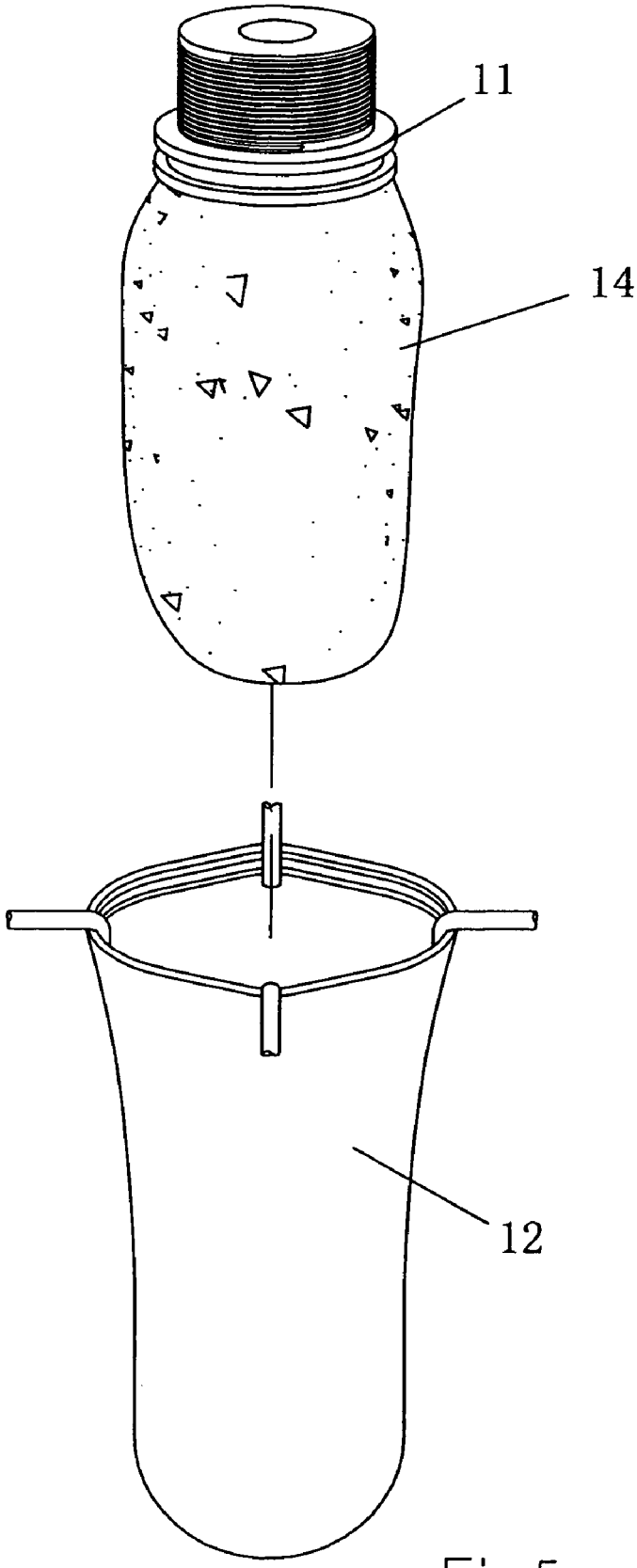
FIG. 5 is a view of the first exemplary embodiment of the pliable handle of the present invention during the handle assembly process.

The assembly, as FIG. 5 shows,

1. Measure the quantity of the gel needed according to the gap which is filled with gel; weigh the gel needed;

2. Cover the outer of the core member below the annular flange 211 of the core member with the gel 24 weighed;

3. Expand the opening of the outer sheath 22, and cover the core member 21 that is covered with the gel 24 with the outer sheath;

Make the inwards extending flange 121 of the outer sheath 12 cover the outwards extending flange 111 of the core member 1, insert The annular flange 122 below the inwards extending flange 121 into the annular groove 112 on the core member 11 and seal it.

At this point, the bottom of the core member 11 is intimately contact with the wall of the bottom of the outer sheath 12, the gap between the portion below the outwards extending flange 111 of the core member 11 and the inner wall of the outer sheath 12 is filled with gel 14 substantially. Screw the thread portion of the big bore 131 of the end cap 13 on the thread portion of the protuberance 113 of the core member 11, press the inwards extending flange 121 of the outer sheath 12 on the outwards extending flange 111 of the core member 11, eliminate the gap between the core member 11 and the outer sheath 12.

For assembling the central rod easily, set the thread portion which corresponds with the thread portion of the tail of the central rod in the bore for central rod. Or setting the rivet-bore in the middle of the core member 11, setting the corresponding rivet-bore on the tail of the central rod; connecting the core member 11 with the tail of the central rod then inserting it into the outer sheath 12.

Figure 7:
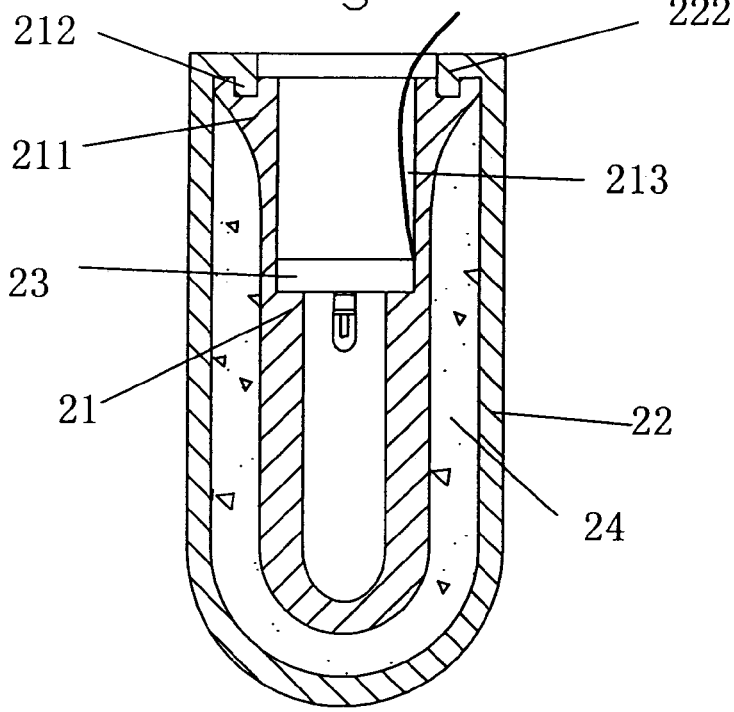
FIG. 7 is a cross-sectional view of the second exemplary embodiment of the pliable handle of FIG. 5
Figure 6:
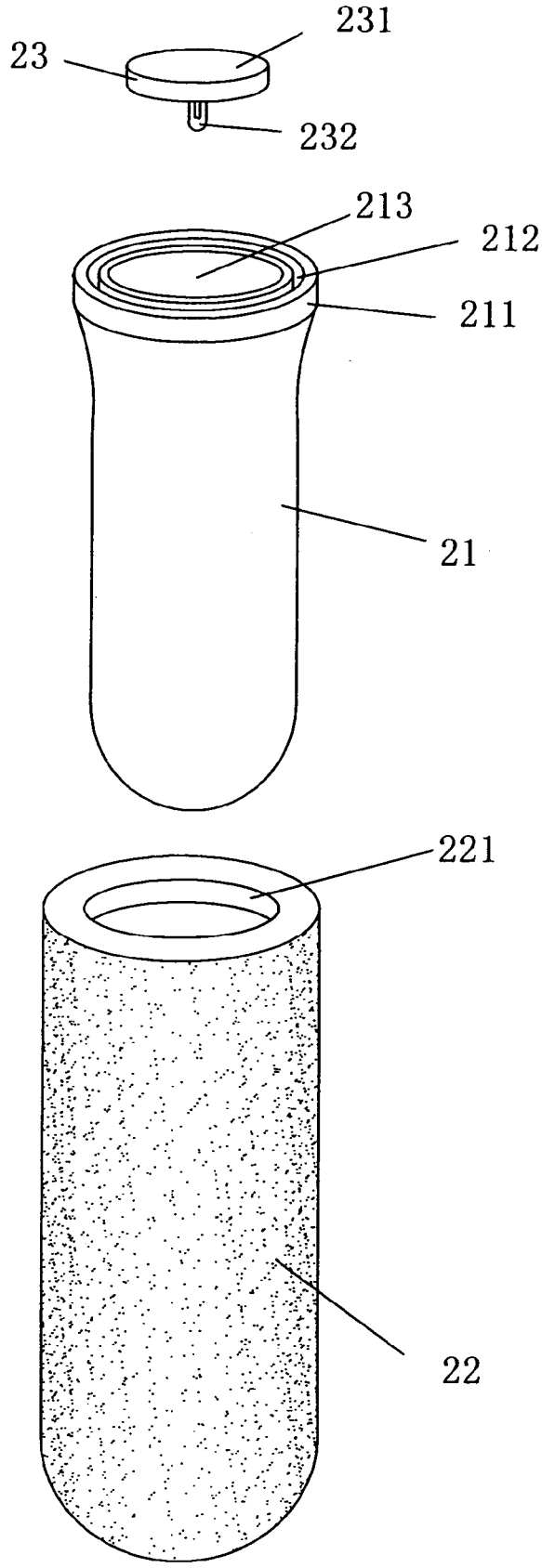
FIG. 6 is an exploded perspective view of the second exemplary embodiment of the pliable handle of the present invention.

The second embodiment, as FIG. 6 FIG. 7 shows, the luminous pliable handle: including the core member 21 the outer sheath 22 and gel body 24 and luminous equipment 23.

The core member 21 is stick-shaped, there is a trapezium-shaped bore 213 downwards on the top of the core member. The outwards extending flange 221 having trumpet-shaped is on the top of the core member 21; an annular groove 212 is on the outwards extending flange 211.

The outer sheath 22 has an opening on top and a closed bottom, there is a inwards extending flange 221 in its opening; there is a annular flange 222 which corresponds with the annular groove 212 on the core member 1 below the inwards extending flange 221.

The luminous equipment 23, including batteries 231, which is disposed on the place trapezium-shaped bore 213 the core member 21, the luminophor 232 is set on the place which is under the trapezium-shaped bore 213.

Figure 8:
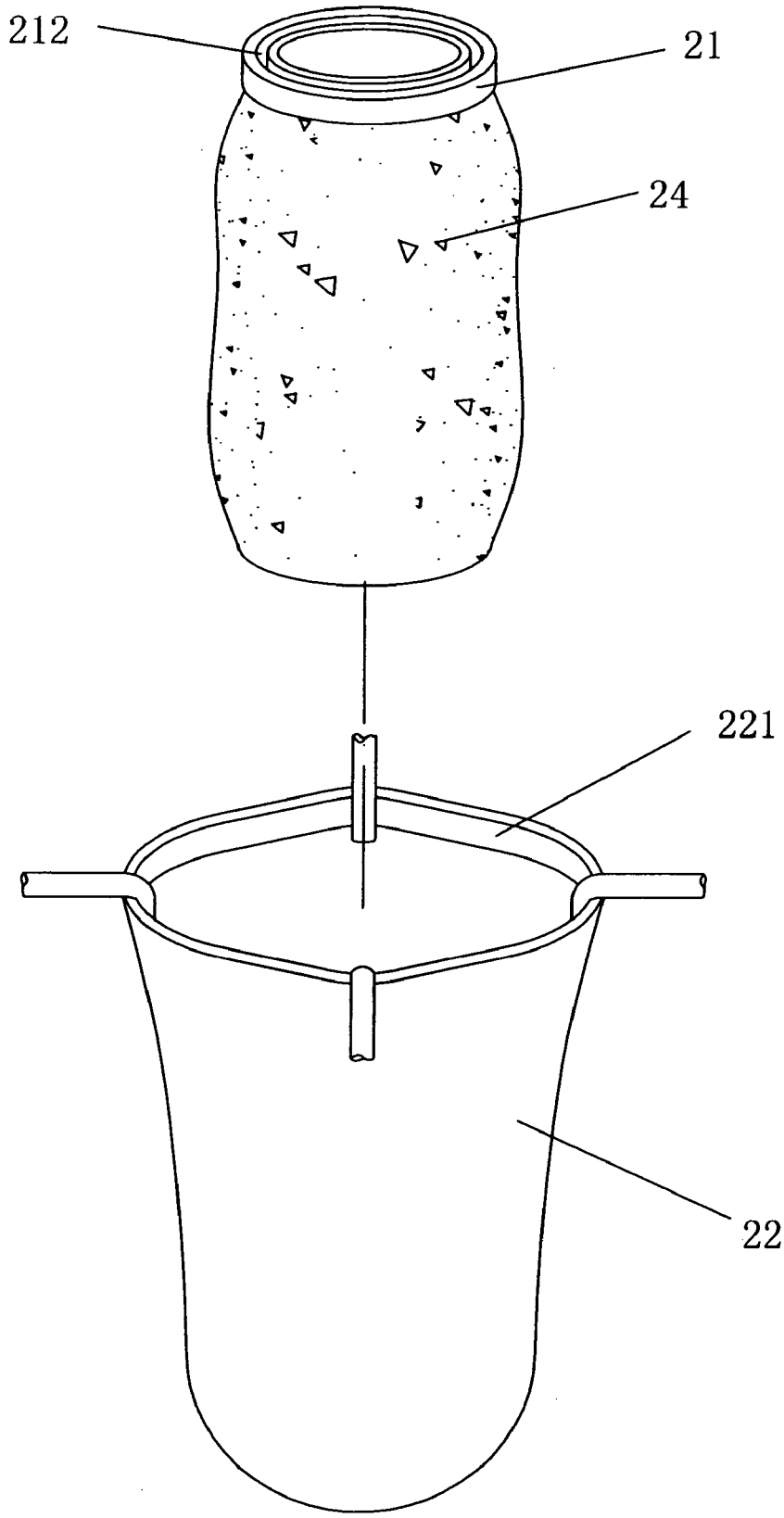
FIG. 8 is a view of the second exemplary embodiment of the pliable handle of the present invention during the handle assembly process.

During the assembly process: as FIG. 8 shows,

Measure the quantity of the gel needed according to the gap which is filled with gel; weigh the gel needed;

Cover the outer of the core member below the annular flange 211 of the core member with the gel 24 weighed;

Expand the opening of the outer sheath 22, and cover the core member 21 that is covered with the gel 24 with the outer sheath;

Make the inwards extending flange 221 of the outer sheath 21 cover the outwards extending flange 211 of the core member 21, wedge the annular flange 222 below the inwards extending flange 221 into the annular groove 212 on the core member 21 and seal it.

Put the luminous equipment 23 into the trapezium-shaped bore 213 of the core member 21.

The present embodiment, a end cap like the end cap 13 of the first embodiment can be set on the top of the core member, or the under parts of central rod for plugging is designed to a corresponding trapezium-shaped manner, and having a function like end cap's, its face presses on the outwards extending flange 221 of the core member, eliminate the gap between the core member 21 and the outer sheath 22.

The present invention is not restricted to 2 said embodiments.

INDUSTRIAL PRACTICABILITY

The structure of the present invention is simple, and it is easy to produce, it is suitable for industrial producing in quantities, having a good industrial practicability.

What is claimed is:

1. A pliable handle, comprising:

a core member with an outwardly extending annular flange around its top portion; and an outer sheath which is a cylinder having a top portion defining an opening and a closed bottom and having an inwardly extending annular flange on its top portion;

said outer sheath being disposed about said core member, and defining a gap between said outer sheath and said core member to contain a gel;

wherein an upper portion of said outwardly extending annular flange of said core member does not communicate with said gap containing said gel, said outwardly extending flange being constructed to seal a top of said gap and defining an annular groove, said outer sheath including an annular flange which corresponds with said annular groove on said core member below said inwardly extending annular flange of said outer sheath.

2. The pliable handle recited in claim 1, wherein said top portion of said core member defines a bore along a longitudinal axis of said core member, said bore does not communicate with said gap containing said gel.

3. The pliable handle recited in claim 1, wherein said core member is transparent, a bore is on the top of the core member along the longitudinal axis of the core member, there is a luminous component in it.

4. The pliable handle recited in claim 1, wherein said outwardly extending annular flange is on said top portion of said core member, said core member further comprising a protuberance having a threaded portion that extends above said outwardly extending annular flange, and a securing component that engages the threaded portion and presses on said inwardly extending annular flange of said outer sheath to form a seal therebetween.

5. The pliable handle recite in claim 4, wherein said securing component is an annular end cap having a threaded portion that engages said threaded portion of said protuberance.

6. The pliable handle recited in claim 1, wherein said core member is transparent, a bore is on the top of the core member along the longitudinal axis of the core member, there is a luminous component in it.

* * * * *